US006432627B1

(12) United States Patent
Yamashita

(10) Patent No.: US 6,432,627 B1
(45) **Date of Patent: *Aug. 13, 2002**

(54) PHOTOTHERMOGRAPHIC ELEMENT

(75) Inventor: Seiji Yamashita, Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/287,134

(22) Filed: Apr. 7, 1999

(30) Foreign Application Priority Data

Apr. 7, 1998 (JP) ..... 10-095080

(51) Int. Cl.[7] ..... G03C 1/498

(52) U.S. Cl. ..... 430/619; 430/531; 430/567; 430/569; 430/568; 430/570; 430/604; 430/607; 430/613; 430/944

(58) Field of Search ..... 430/619, 620, 430/569, 567, 568, 607, 613, 604, 531, 570, 944

(56) References Cited

U.S. PATENT DOCUMENTS 5,340,712 A * 8/1994 Dunn et al. ..... 430/619
5,851,755 A * 12/1998 Uytterhoeven et al. ..... 430/619
5,891,615 A * 4/1999 Winslow et al. ..... 430/603
5,965,346 A * 10/1999 Inagaki et al. ..... 430/619

* cited by examiner

*Primary Examiner*—Thorl Chea
(74) *Attorney, Agent, or Firm*—Birch, Stewart, Kolasch & Birch, LLP

(57) ABSTRACT

A photothermographic element has on a support a photosensitive layer containing an emulsion of silver halide fine grains having a mean equivalent spherical diameter of 10–50 nm. (1) The silver halide emulsion has been formed independent of an organic fatty acid silver salt rather than by partial halogen conversion of a non-photosensitive organic silver salt, and mixed with the organic silver salt before coating. (2) A reducing agent for silver ion is contained. (3) The silver halide fine grains have been chemically sensitized in the presence of a spectral sensitizing dye. The element is improved in sensitivity and restrained from fog increase during storage in daylight after processing.

16 Claims, No Drawings

PHOTOTHERMOGRAPHIC ELEMENT

This invention relates to a method of preparing a photothermographic element and more particularly, to a method of preparing a photothermographic element having a high sensitivity and experiencing, after processing, a of fog during storage in daylight.

BACKGROUND OF THE INVENTION

From the contemporary standpoints of environmental protection and space saving, it is strongly desired in the medical diagnostic field to reduce the quantity of spent solution. Needed in this regard is a technology relating to thermographic photosensitive materials for use in the medical diagnostic and photographic fields which can be effectively exposed by means of laser image setters or laser imagers and produce clear black images of high resolution and sharpness. These thermographic photosensitive materials eliminate a need for wet processing chemicals and offer a simple, environmentally friendly, thermographic system to the customer.

However, these photothermographic elements do not entail developing agents (reducing agents) and the fixation of undeveloped silver as opposed to wet processing, and give rise to the problem that the print-out of silver halide after processing can alter the images. This problem can be avoided by reducing the size of silver halide grains or by reducing the silver coverage thereof, but at the expense of sensitivity or image density.

It is well known in the art that if the size of silver halide grains is significantly reduced to the range below 50 nm, which is within the scope of the present invention, various inefficiencies during exposure considerably accumulate to induce a substantial drop of sensitivity. On the other hand, increasing sensitivity often invites an increase of fog at the same time. This makes it difficult to find a compromise between sensitivity and fog for photothermographic elements susceptible to fog.

SUMMARY OF THE INVENTION

An object of the present invention is to provide a photothermographic element which has a high sensitivity and low fog, an ability to minimize a drop of image quality by a fog increase due to the print-out silver during storage in daylight after processing, and age stability before processing.

Another object of the present invention is to provide a photothermographic element in which age stability is endowed to a silver halide emulsion so that the variation among different coating lots is minimized.

According to the invention, there is provided a photothermographic element comprising at least one photosensitive layer on a support. The element contains an emulsion of silver halide fine grains having a mean equivalent spherical diameter of 10 to 50 nm, and further contains a non-photosensitive silver salt of organic aliphatic acid (referred to as organic silver salt, hereinafter), and a reducing agent for silver ion. The silver halide emulsion has been preformed independent of the organic silver salt and subsequently mixed with the organic silver salt before coating. That is, the silver halide emulsion is a preformed one. Differently stated, the silver halide emulsion is not formed by partial halogen conversion of an organic silver salt. Additionally, the silver halide fine grains have been chemically sensitized in the presence of a spectral sensitizing dye.

Several preferred embodiments of the invention are given below.

(1) The emulsion has been subjected to selenium sensitization or tellurium sensitization or both.

(2) The emulsion contains $10^{-5}$ to $10^{-3}$ mol of a polyvalent metal ion per mol of the silver halide. More preferably, the polyvalent metal ion is an iridium, ruthenium or iron ion and coordinates with a Cl, Br or CN ion.

(3) Of the faces of the silver halide fine grains of the emulsion, {100} face accounts for 50 to 100%.

(4) The silver halide fine grains of the emulsion have been formed in the presence of an oxidizing agent for silver.

(5) The silver halide fine grains have a mean equivalent spherical diameter of 10 to 30 nm.

(6) The spectral sensitizing dye is a merocyanine dye having an absorption peak at a wavelength in the range of 600 to 1,000 nm.

(7) The silver halide fine grains have a silver iodide content of 0 to 5 mol %.

(8) The emulsion further contains a triazine compound.

(9) A water-soluble polymer or water-dispersible polymer or both is used as a binder in the element.

DETAILED DESCRIPTION OF THE INVENTION

Silver Halide

The halogen composition of photosensitive silver halide is not critical and may be any of silver chloride, silver chlorobromide, silver bromide, silver iodobromide, and silver iodochlorobromide. The silver halide preferably has a silver iodide content of up to 5 mol %. The halogen composition in silver halide grains may have a uniform distribution or a non-uniform distribution wherein the halogen concentration changes in a stepped or continuous manner. Silver halide grains of the core/shell structure are also useful. Such core/shell grains preferably have a multilayer structure of 2 to 5 layers, more preferably 2 to 4 layers. Silver chloride or silver chlorobromide grains having silver bromide localized on surfaces thereof are also useful.

A method for forming the photosensitive silver halide is well known in the art. Any of the methods disclosed in *Research Disclosure* No. 17029 (June 1978) and U.S. Pat. No. 3,700,458, for example, may be used. One illustrative method which can be used herein is a method of adding a silver-providing compound and a halogen-providing compound to a solution of gelatin or another polymer to preform photosensitive silver halide grains and mixing the grains with an organic silver salt.

The photosensitive silver halide should preferably have a smaller grain size for the purposes of minimizing white turbidity, fog after image formation and a fog increase by print-out silver. Specifically, the grain size is 10 to 50 nm, preferably 10 to 45 nm, more preferably 10 to 40 nm, most preferably 10 to 30 nm. The term grain size designates the diameter of an equivalent sphere having the same volume as a grain.

The shape of silver halide grains may be cubic, octahedral, tabular, spherical, rod-like and potato-like, with cubic grains being preferred in the practice of the invention. Silver halide grains having rounded corners are also preferably used. No particular limit is imposed on the face indices (Miller indices) of an outer surface of photosensitive silver halide grains. Preferably silver halide grains have a high proportion of {100} face featuring high spectral sensitization efficiency upon adsorption of a spectral sensitizing dye. The proportion of {100} face is preferably 50% to 100%, more preferably at least 65%, most preferably at least 80% of the entire faces. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

Polyvalent Metal Ion

The silver halide grains used herein preferably contain in their crystal lattices a metal belonging to Groups 3 to 14 of Periods 4, 5 and 6 in the Periodic Table (new IUPAC), in the form of a coordination metal complex or metal ion. These metals may take the form of metal salts such as ammonium salts, acetate salts, nitrate salts, sulfate salts, phosphate salts, hydroxide salts, and be used as metal ions. The use of metals in the form of mononuclear coordination metal complex salts (such as six-coordinate complexes and four-coordinate complexes), binuclear metal complex salts or polynuclear metal complex salts can take advantage of the function of a ligand or complex structure.

When metals are used in the form of coordination metal complexes, the preferred ligands include halo (X), aquo ($H_2O$), azido ($N_3$), cyano (CN), cyanate (OCN), thiocyanate (SCN), selenocyanate (SeCN), tellurocyanate (TeCN), nitrosil (NO), thionitrosil (NS), oxo (O) or carbonyl (CO). The metal complex may have an organic ligand containing at least one carbon-carbon, carbon-hydrogen or carbon-nitrogen-hydrogen bond, such as 4,4'-bipyridine, pyrazine, and thiazole as disclosed in U.S. Pat. No. 5,360,712.

Illustratively, use may be made of Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals may be added in the form of salts which can be dissolved upon grain formation, such as ammonium salts, acetate salts, nitrate salts, sulfate salts, phosphate salts, and hydroxide salts as well as six-coordinate complexes and four-coordinate complexes. Examples are $CdBr_2$, $CdCl_2$, $Cd(NO_3)_2$, $Pd(NO_3)_2$, $Pd(CH_3COO)_2$, $K_3[Fe(CN)_6]$, $(NH_4)_4[Fe(CN)_6]$, $KIrCl_6$, $(NH_4)_3RhCl_6$, and $K_4RU(CN)_6$. The ligand of the coordination compound may be selected from halo, aquo, cyano, cyanate, thiocyanate, nitrosil, thionitrosil, oxo or carbonyl. The metal moiety of the coordination compound may be a single metal or a mixture of two or more metal elements.

It is sometimes useful to add chalcogen compounds during emulsion preparation as described in U.S. Pat. No. 3,772,031. Besides S, Se, and Te, there may be present a cyan salt, thiocyan salt, selenocyan salt, carbonate salt, phosphate salt or acetate salt.

In the practice of the invention, the coordination metal complex or metal ion may be added after dissolving it in water or a mixture of water and an appropriate water-miscible organic solvent such as an alcohol, ether, glycol, ketone, ester or amide.

For the silver halide emulsion used herein, the coordination metal complex or metal ion is preferably present during emulsion preparation and thus added, for example, during grain formation, during desalting step, during chemical sensitization, or before coating. When grains are doped with the coordination metal complex or metal ion, it is preferably added during grain formation. When the coordination metal complex or metal ion is used for modification of grain surfaces or as a chemical sensitizer, it is preferably added after grain formation and before the completion of chemical sensitization. In the case of doping, a choice may be made among entire doping of grains, doping of only the core or shell of grains, doping of only the epitaxial portion of grains, and doping of only the substrate grains.

When the silver halide grains are doped with the coordination metal complex or metal ion, the coordination metal complex or metal ion is preferably added directly to the reaction solution during silver halide grain formation, or it is first added to a solution containing halide ions from which silver halide grains are formed or another solution and then to the grain-forming reaction solution. A combination of various such addition methods is possible.

When the silver halide grains are doped with the coordination metal complex or metal ion, the metal may be uniformly present within the grains or doped to a higher concentration in a grain surface layer as disclosed in JP-A 208936/1992, 125245/1990, and 188437/1991. Also, as disclosed in U.S. Pat. No. 5,256,530, a grain surface layer may be modified by the physical ripening of doped fine grains. Such a method of doping silver halide grains with the coordination metal complex or metal ion is also preferable which involves the steps of preparing doped fine grains, adding the fine grains, and effecting physical ripening. A combination of these doping methods may also be employed.

The coordination metal complex or metal ion used in the preferred embodiment of the invention may be incorporated into silver halide grains in the concentration per mol of silver commonly employed in the art for transition metal doping. For the transition metal doping, a very wide range of concentration is known, for example, from a low concentration of $10^{-10}$ mol per mol of silver as disclosed in JP-A 107129/1976 to a high concentration of $10^{-3}$ mol per mol of silver as disclosed in U.S. Pat. Nos. 3,687,676 and 3,690,891. The effective concentration largely varies with the silver halide content of grains, the type and oxidation state of a particular coordination metal complex or metal ion, the type of a ligand, if any, and the desired photographic effect.

In the silver halide emulsion of the invention, the content of polyvalent metal ion is preferably $10^{-10}$ to $10^{-3}$ mol, more preferably $10^{-5}$ to $10^{-3}$ mol per mol of the silver halide.

The doping amount or factor of the coordination metal complex or metal ion in silver halide grains may be quantitatively determined by such analysis as atomic absorption spectrometry, inductively coupled plasma spectrometry (ICP) or inductively coupled plasma mass spectrometry (ICPMS).

Illustrative examples of the coordination metal complex or metal ion are those described in "Comprehensive Coordination Chemistry," Pergamon Press (1987). Of these, the preferred polyvalent metal ions are iridium, ruthenium and iron ions, and the preferred ligands are Cl, Br, and CN ions.

Photosensitive silver halide grains may be desalted by any of well-known water washing methods such as noodle and flocculation methods although silver halide grains may be either desalted or not according to the invention.

When the silver halide emulsion according to the invention is subject to gold sensitization, there may be used any of gold sensitizers whose gold may have an oxidation number of +1 or +3. Conventional gold sensitizers are useful. Typical examples include chloroauric acid, potassium chloroaurate, auric trichloride, potassium auric thiocyanate, potassium iodoaurate, tetracyanoauric acid, ammonium aurothiocyanate, and pyridyl trichlorogold. The amount of the gold sensitizer added varies with various conditions although it is typically $1\times10^{-7}$ to $1\times10^{-3}$ mol, preferably $1\times10^{-6}$ to $5\times10^{-4}$ mol per mol of the silver halide.

The silver halide emulsion used herein should preferably be subject to gold sensitization and another chemical sensitization in combination. The chemical sensitization methods which can be used herein are sulfur, selenium, tellurium, and noble metal sensitization methods which are well known in the art. When they are used in combination with gold sensitization, preferred combinations are a combination of sulfur sensitization with gold sensitization, a combination of selenium sensitization with gold sensitization, a combination of sulfur sensitization and selenium sensitization with gold sensitization, a combination of sulfur sensitization and tellurium sensitization with gold sensitization, and a combination of sulfur sensitization, selenium sensitization, and tellurium sensitization with gold sensitization.

In the practice of the invention, selenium sensitization or tellurium sensitization is preferably employed for increased sensitivity.

Sulfur sensitization that is preferably employed in the invention is generally carried out by adding a sulfur sensitizer to an emulsion and agitating the emulsion at an elevated temperature above 40° C. for a certain time. The sulfur sensitizers used herein are well-known sulfur compounds, for example, sulfur compounds contained in gelatin as well as various sulfur compounds such as thiosulfates, thioureas, thiazoles, and rhodanines. Preferred sulfur compounds are thiosulfate salts and thiourea compounds. The amount of the sulfur sensitizer added varies with chemical ripening conditions including pH, temperature and silver halide grain size although it is preferably $1\times10^{-7}$ to $1\times10^{-2}$ mol, more preferably $1\times10^{-5}$ to $1\times10^{-3}$ mol per mol of silver halide.

It is also useful to use selenium sensitizers which include well-known selenium compounds. Specifically, selenium sensitization is generally carried out by adding an unstable selenium compound and/or non-unstable selenium compound to an emulsion and agitating the emulsion at elevated temperature above 40° C. for a certain time. Preferred examples of the unstable selenium compound include those described in JP-B 15748/1969, JP-B 13489/1968, JP-A 25832/1992, JP-A 109240/1992 and JP-A 121798/1991. Especially preferred are the compounds represented by general formulae (VIII) and (IX) in JP-A 324855/1992.

The tellurium sensitizers are compounds capable of forming silver telluride, which is presumed to become sensitization nuclei, at the surface or in the interior of silver halide grains. The production rate of silver telluride in a silver halide emulsion can be determined by the test method described in JP-A 313284/1993. Exemplary tellurium sensitizers include diacyltellurides, bis(oxycarbonyl)tellurides, bis(carbamoyl)tellurides, bis(oxycarbonyl)ditellurides, bis (carbamoyl)ditellurides, compounds having a P═Te bond, tellurocarboxylic salts, Te-organyltellurocarboxylic esters, di(poly)tellurides, tellurides, telluroles, telluroacetals, tellurosulfonates, compounds having a P—Te bond, Te-containing heterocycles, tellurocarbonyl compounds, inorganic tellurium compounds, and colloidal tellurium. Examples are described in U.S. Pat. Nos. 1,623,499, 3,320, 069, 3,772,031, BP 235,211, 1,121,496, 1,295,462, 1,396, 696, Canadian Patent No. 800,958, JP-A 204640/1992, 53693/1991, 131598/1991, and 129787/1992, J. Chem. Soc. Chem. Commun., 635 (1980), ibid., 1102 (1979), ibid., 645 (1979), J. Chem. Soc. Perkin. Trans., 1, 2191 (1980), S. Patai Ed., The Chemistry of Organic Selenium and Tellurium Compounds, Vol. 1 (1986), ibid., Vol. 2 (1987). Especially preferred are the compounds represented by general formulae (II), (III) and (IV) in JP-A 313284/1993.

The amounts of the selenium and tellurium sensitizers used vary with the type of silver halide grains, chemical ripening conditions and other factors although they are preferably about $1\times10^{-8}$ to $1\times10^{-2}$ mol, more preferably about $1\times10^{-7}$ to $1\times10^{-3}$ mol per mol of silver halide. The chemical sensitizing conditions are not particularly limited although preferred conditions include a pH of 5 to 8, a pAg of 6 to 11, more preferably 7 to 10, and a temperature of 40 to 95° C., more preferably 45 to 85° C.

In the preparation of the silver halide emulsion used herein, any of cadmium salts, sulfite salts, lead salts, and thallium salts may be co-present in the silver halide grain forming step or physical ripening step.

Reduction sensitization may also be used in the practice of the invention. Illustrative examples of the compound used in the reduction sensitization method include ascorbic acid, thiourea dioxide, stannous chloride, aminoiminomethanesulfinic acid, hydrazine derivatives, borane compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

To the silver halide emulsion according to the invention, thiosulfonic acid compounds may be added by the method described in EP-A 293,917.

The silver halide emulsion in the photothermographic element according to the invention may be a single emulsion or a mixture of two or more emulsions which are different in mean grain size, halogen composition, crystal habit or chemical sensitizing conditions.

According to the invention, the photosensitive silver halide is preferably used in an amount of 0.01 to 0.5 mol, more preferably 0.02 to 0.3 mol, most preferably 0.02 to 0.20 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding the already prepared photosensitive silver halide at any timing during preparation of an organic silver salt. Any desired mixing method may be used insofar as the benefits of the invention are fully achievable.

The time when the silver halide is added to an image forming layer coating solution is preferably from 180 minutes before coating to immediately before coating, more preferably from 60 minutes before coating to 10 seconds before coating. The mixing method and conditions are not particularly limited insofar as the benefits of the invention are fully achievable. Illustrative mixing methods include a method of mixing in a tank such that the average residence time calculated from a flow rate of addition and a delivery rate to a coater may be as desired and a mixing method using the static mixer described in N. Harnby, F. Edwards and A. W. Nienow (translator Takahashi), Liquid Mixing Technology, Nikkan Kogyo Shinbun, 1989, Chap. 8.

Sensitizing Dye

A sensitizing dye is present during chemical sensitization of the silver halide grains. There may be used any of sensitizing dyes which can spectrally sensitize silver halide grains in a desired wavelength region (of at least 600 nm) when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in *Research Disclosure,* Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and process cameras.

Exemplary dyes for spectral sensitization to red light include compounds I-1 to I-38 described in JP-A 18726/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for red light sources such as He–Ne lasers, red laser diodes, and LED.

For compliance with laser diode light sources in the wavelength range of 750 to 1,400 nm, it is advantageous to spectrally sensitize silver halide grains. Such spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole or imidazole nucleus. Preferred examples of the useful merocyanine dye contain an acidic nucleus such as a thiohydantoin, rhodanine, oxazolidinedione, thiazolinedione, barbituric acid, thiazolinone, malononitrile or pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, BP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether bond-containing substituent, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, Publication of International Patent Application No. 50111/1993, BP 1,467,638, and U.S. Pat. No. 5,281,515.

Also useful in the practice of the invention are dyes capable of forming the J-band as disclosed in U.S. Pat. Nos. 5,510,236, 3,871,887 (Example 5), JP-A 96131/1990 and 48753/1984.

Of these dyes, merocyanine dyes exhibiting an absorption peak at a wavelength in the range of 600 to 1,000 nm are especially preferred in view of residual color and sensitivity although few of them are added before chemical sensitization in the prior art because of poor adsorption. These merocyanine dyes are outstandingly effective as compared with the cyanine dyes.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in *Research Disclosure,* Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process as long as the sensitizing dye is present during chemical sensitization. The sensitizing dye may be added to the emulsion, for example, during the silver halide grain forming step and/or a stage prior to the desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

Although various addition methods can be employed, it is necessary to add the spectral sensitizing dye such that the dye is present during chemical sensitization. In the practice of the invention, the sensitizing dye is preferably added at a stage from the end of desalting to the start of chemical sensitization.

The amount of the sensitizing dye used may be an appropriate amount complying with sensitivity and fog although the preferred amount is about $10^{-6}$ to 1 mol, more preferably $10^{-4}$ to $10^{-1}$ mol per mol of the silver halide in the photosensitive layer.

Oxidizing Agent

An oxidizing agent for silver (which designates ultrafine silver nuclei of the order of several atoms serving as physical development nuclei) may be selected, for example, from aqueous hydrogen peroxide, mercury, bromosuccinimides, polyhalides, disulfides, iodine, bromine, and chlorine. Also useful are the compounds of formulae (i), (ii), and (iii) and thiosulfonic acid compounds as exemplified by Compounds 1-1 to 1-33, 2-1 to 2-25, and 3-1 to 3-9 described in JP-A 105139/1990.

The time when the oxidizing agent is added may be during grain formation or at any point of time until the end of chemical sensitization. Preferably the oxidizing agent is present during grain formation or at the end of grain formation. The amount of oxidizing agent added may be determined as appropriate depending on the oxidizing power thereof although it is preferably about $10^{-6}$ to $10^{-1}$ mol per mol of silver.

Increase of {100} Face Proportion

As grains become finer, their crystal habit becomes unstable. Even when silver halide grains are formed under such conditions that cubic grains normally form, the grains become rounded. However, the rounding of grains causes a substantial drop of sensitivity because the {100} face has less inherent desensitization and good color sensitization efficiency as is well known in the art. In order to prevent the sensitivity drop, various steps must be taken in the formation of fine grains. It is preferable and important in forming high-sensitivity ultrafine grains that {100} face accounts for at least 50% of the entire faces of grains.

Effective means for increasing the proportion of {100} face include (1) to effect grain growth at low temperatures, (2) to cause a {100} face-adsorbing compound having a pKa of up to 6.0 (suggesting that the majority of the compound is removed in flocculation, desalting and water washing steps at pH 5.0 or lower) such as a benzimidazole or a mercapto compound to be adsorbed on grains as a crystal habit controlling agent for retaining the grain shape, and (3) to add a dye in a chemical sensitization step at a relatively high temperature before the start of chemical sensitization, as will be shown later in Examples. An appropriate amount of the adsorbing compound used is about $10^{-5}$ to $10^{-1}$ mol per mol of silver halide.

Triazine Compound

In one preferred embodiment of the invention, a triazine compound is added to the emulsion for the purpose of stabilizing the performance of the emulsion after its formation. Illustrative triazine compounds are the compounds of formula (iii) in JP-A 11791/1994, especially Compounds iii-1 to iii-21 illustrated therein though not limited thereto. The triazine compound may be added at any of grain formation, desalting/water washing, and dispersion/chemical ripening steps, preferably at or after the desalting/water washing step. An appropriate amount of the triazine compound added is about $10^{-6}$ to $10^{-2}$ mol per mol of silver halide though not limited thereto.

Organic Silver Salt

The organic aliphatic acid silver salt used herein is a silver salt which is relatively stable to light, but forms a silver image when heated at 80° C. or higher in the presence of an exposed photocatalyst (as typified by a latent image of photosensitive silver halide) and a reducing agent. Preferred organic aliphatic acid silver salts are silver salts of long-chain aliphatic carboxylic acids having 10 to 30 carbon atoms, especially 15 to 28 carbon atoms. The organic aliphatic acid silver salt preferably constitutes about 5 to 70% by weight of the image-forming layer. Preferred examples of the organic aliphatic acid silver salt include silver behenate, silver arachidate, silver stearate, silver oleate, silver laurate, silver caproate, silver myristate, silver palmitate, silver maleate, silver fumarate, silver tartrate, silver linolate, silver butyrate, silver camphorate and mixtures thereof.

Typically, the organic aliphatic acid silver salt (also referred to as organic silver salt or organic acid silver) used herein is formed by reacting silver nitrate with a solution or suspension of an alkali metal salt (e.g., sodium, potassium or lithium salt) of an organic aliphatic acid as described above. The organic acid alkali metal salt is obtained by treating the organic aliphatic acid with an alkali. The preparation of the organic silver salt may be carried out in any suitable reactor in a batchwise or continuous manner. Agitation in the reactor may be carried out by any desired method depending on the characteristics required for organic acid silver grains. The organic acid silver may be prepared by a method of slowly or rapidly adding an aqueous solution of silver nitrate to a reactor charged with a solution or suspension of an organic acid alkali metal salt; a method of slowly or rapidly adding a preformed solution or suspension of an organic acid alkali metal salt to a reactor charged with an aqueous solution of silver nitrate; or a method of simultaneously adding a preformed aqueous solution of silver nitrate and a preformed solution or suspension of an organic acid alkali metal salt to a reactor.

As to the addition of the silver nitrate aqueous solution and the organic acid alkali metal salt solution or suspension, both the solutions may have any suitable concentrations for the desired grain size of the organic acid silver grains to be formed therefrom. They may be added at any desired rates. A constant addition method of adding them at a constant rate or an accelerated or decelerated addition method of accelerating or decelerating the addition rate as a function of time may be employed. The solutions may be added to or below the surface of the reaction solution. In the method of simultaneously adding a preformed silver nitrate aqueous solution and a preformed organic acid alkali metal salt solution or suspension to a reactor, either one of the solutions may be partially added in advance. Preferably the silver nitrate aqueous solution is added in advance. An appropriate amount of one solution added in advance of the other solution is 0 to 50%, more preferably 0 to 25% by volume of the entirety. As described in JP-A 127643/1997, it is also preferable to add both the solutions while controlling the pH or silver potential of the reaction solution.

The silver nitrate aqueous solution and the organic acid alkali metal salt solution or suspension may be adjusted to suitable pH levels depending on the desired characteristics required for the organic acid silver grains. For pH adjustment, any suitable acid or alkali may be added. Depending on the characteristics required for the organic acid silver grains, for example, for controlling the size of organic acid silver grains, the temperature in the reactor may be set at a suitable level. Similarly, the temperatures of the silver nitrate aqueous solution and the organic acid alkali metal salt solution or suspension to be added may also be set at suitable levels. Typically, the organic acid alkali metal salt solution or suspension is heated and maintained at or above 50° C. in order to keep it flowable.

Preferably, the organic acid silver used herein is prepared in the presence of a tertiary alcohol. The tertiary alcohols used herein are preferably those of up to 15 carbon atoms in total, more preferably up to 10 carbon atoms in total. Tert-butanol is the preferred tertiary alcohol although the invention is not limited thereto.

The tertiary alcohol may be added at any stage during preparation of the organic acid silver. Preferably the tertiary alcohol is added during preparation of an organic acid alkali metal salt whereby the organic acid alkali metal salt is dissolved in the alcohol. The amount of the tertiary alcohol used is such that the weight ratio of tertiary alcohol to water may fall in the range from 0.01 to 10 provided that water ($H_2O$) is used as the solvent during preparation of the organic acid silver. The preferred weight ratio of tertiary alcohol to water falls in the range from 0.03 to 1.

The organic silver salt which can be used herein may take any desired shape although needle crystals having a minor axis and a major axis are preferred. In the practice of the invention, grains should preferably have a minor axis or breadth of 0.01 μm to 0.20 μm and a major axis or length of 0.10 μm to 5.0 μm, more preferably a minor axis of 0.01 μm to 0.15 μm and a major axis of 0.10 μm to 4.0 μm. The grain size distribution of the organic silver salt is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image of a grain dispersion obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the auto-correlation function of the fluctuation of scattering light relative to a time change, and obtaining the grain size (volume weighed mean diameter) therefrom.

The organic silver salt used herein is preferably desalted. The desalting method is not critical. Any well-known method may be used although well-known filtration methods such as centrifugation, suction filtration, ultrafiltration, and flocculation/water washing are preferred.

For the purpose of obtaining a solid particle dispersion of an organic silver salt having a high S/N ratio and a small particle size and free of agglomeration, use is preferably made of a dispersion method involving the steps of converting a water dispersion containing an organic silver salt as an image forming medium, but substantially free of a photosensitive silver salt into a high pressure, high speed flow, and causing a pressure drop to the flow. Thereafter, the dispersion is mixed with an aqueous solution of a photosensitive silver salt, thereby preparing a photosensitive image-forming medium coating solution.

When a photothermographic element is prepared using this coating solution, the resulting photothermographic element has a low haze, low fog and high sensitivity. In contrast, if a photosensitive silver salt is co-present when an organic silver salt is dispersed in water by converting into a high pressure, high speed flow, then there result a fog increase and a substantial sensitivity decline. If an organic solvent is used instead of water as the dispersing medium, then there result a haze increase, a fog increase and a sensitivity decline. If a conversion technique of converting a portion of an organic silver salt in a dispersion into a photosensitive silver salt is employed instead of mixing a photosensitive silver salt aqueous solution, then there results a sensitivity decline.

The water dispersion which is dispersed by converting into a high pressure, high speed flow should be substantially free of a photosensitive silver salt. The content of photosensitive silver salt is less than 0.1 mol % based on the non-photosensitive organic silver salt. The positive addition of photosensitive silver salt is avoided.

With respect to the solid dispersing technology and apparatus employed in carrying out the above-described dispersion method of the invention, reference should be made to Kajiuchi and Usui, "Dispersed System Rheology and Dispersing Technology," Shinzansha Publishing K.K., 1991, pp. 357–403; and Tokai Department of the Chemical Engineering Society Ed., "Progress of Chemical Engineering, Volume 24," Maki Publishing K.K., 1990, pp. 184–185. According to the dispersion method recommended above, a water dispersion liquid containing at least an organic silver salt is pressurized by a high pressure pump or the like, fed into a pipe, and passed through a narrow slit in the pipe whereupon the dispersion liquid is allowed to experience an abrupt pressure drop, thereby accomplishing fine dispersion.

Such a high pressure homogenizer which is used in the practice of the invention is generally believed to achieve dispersion into finer particles under the impetus of dispersing forces including (a) "shear forces" exerted when the dispersed phase is passed through a narrow gap under high pressure and at a high speed and (b) "cavitation forces" exerted when the dispersed phase under high pressure is released to atmospheric pressure. As the dispersing apparatus of this type, Gaulin homogenizers are known from the past. In the Gaulin homogenizer, a liquid to be dispersed fed under high pressure is converted into a high-speed flow through a narrow slit on a cylindrical surface and under that impetus, impinged against the surrounding wall surface, achieving emulsification and dispersion by the impact forces. The pressure used is generally 100 to 600 kg/cm$^2$ and the flow velocity is from several meters per second to about 30 m/sec. To increase the dispersion efficiency, improvements are made on the homogenizer as by modifying a high-flow-velocity section into a saw-shape for increasing the number of impingements. Apart from this, apparatus capable of dispersion at a higher pressure and a higher flow velocity were recently developed. Typical examples of the advanced dispersing apparatus are available under the trade name of Micro-Fluidizer (Microfluidex International Corp.) and Nanomizer (Tokushu Kika Kogyo K.K.).

Examples of appropriate dispersing apparatus which are used in the practice of the invention include Micro-Fluidizer M-110S-EH (with G10Z interaction chamber), M-110Y (with H10Z interaction chamber), M-140K (with G10Z interaction chamber), HC-5000 (with L30Z or H230Z interaction chamber), and HC-8000 (with E230Z or L30Z interaction chamber), all available from Microfluidex International Corp.

Using such apparatus, a water dispersion liquid containing at least an organic silver salt is pressurized by a high pressure pump or the like, fed into a pipe, and passed through a narrow slit in the pipe for applying a desired pressure to the liquid and. thereafter, the pressure within the pipe is quickly released to atmospheric pressure whereby the dispersion liquid experiences an abrupt pressure drop, thereby yielding an organic silver salt dispersion adequate for use in the invention.

Prior to the dispersing operation, the starting liquid is preferably pre-dispersed. For such pre-dispersion, there may be used any of well-known dispersing means, for example, high-speed mixers, homogenizers, high-speed impact mills, Banbury mixers, homomixers, kneaders, ball mills, vibrating ball mills, planetary ball mills, attritors, sand mills, bead mills, colloid mills, jet mills, roller mills, trommels, and high-speed stone mills. Rather than such mechanical dispersion, the pre-dispersion may be carried out by controlling the pH of the starting liquid for roughly dispersing particles in a solvent, and then changing the pH in the presence of dispersing agents for fine graining. The solvent used in the rough dispersing step may be an organic solvent although the organic solvent is usually removed after the completion of fine graining.

According to the invention, the organic silver salt dispersion can be dispersed to a desired particle size by adjusting a flow velocity, a differential pressure upon pressure drop, and the number of dispersing cycles. From the standpoints of photographic properties and particle size, it is preferable to use a flow velocity of 200 to 600 m/sec and a differential pressure upon pressure drop of 900 to 3,000 kg/cm$^2$, and especially a flow velocity of 300 to 600 m/sec and a differential pressure upon pressure drop of 1,500 to 3,000 kg/cm$^2$. The number of dispersing cycles may be selected as appropriate although it is usually 1 to 10. From the productivity standpoint, the number of dispersing cycles is 1 to about 3. It is not recommended from the standpoints of dispersibility and photographic properties to elevate the temperature of the water dispersion under high pressure. High temperatures above 90° C. tend to increase the particle size and the fog due to poor dispersion. Accordingly, in the preferred embodiment of the invention, a cooling step is provided prior to the conversion step and/or after the pressure drop step whereby the water dispersion is maintained at a temperature in the range of 5 to 90° C., more preferably 5 to 80° C. and most preferably 5 to 65° C. It is effective to use the cooling step particularly when dispersion is effected under a high pressure of 1,500 to 3,000 kg/cm$^2$. The cooling means used in the cooling step may be selected from various coolers, for example, double tube type heat exchangers, static mixer-built-in double tube type heat exchangers, multi-tube type heat exchangers, and serpentine heat exchangers, depending on the necessary quantity of heat exchange. For increasing the efficiency of heat exchange, the diameter, gage and material of the tube are selected as appropriate in consideration of the pressure applied thereto. Depending on the necessary quantity of heat exchange, the refrigerant used in the heat exchanger may be selected from well water at 20° C., cold water at 5 to 10° C. cooled by refrigerators, and if necessary, ethylene glycol/water at −30° C.

In the dispersing operation according to the invention, the organic silver salt is preferably dispersed in the presence of dispersants or dispersing agents soluble in an aqueous medium. The dispersing agents used herein include synthetic anionic polymers such as polyacrylic acid, acrylic acid copolymers, maleic acid copolymers, maleic acid monoester copolymers, and acryloylmethylpropanesulfonic acid copolymers; semi-synthetic anionic polymers such as carboxymethyl starch and carboxymethyl cellulose; anionic polymers such as alginic acid and pectic acid; the compounds described in JP-A 350753/1995; well-known anionic, nonionic and cationic surfactants; well-known polymers such as polyvinyl alcohol, polyvinyl pyrrolidone, carboxymethyl cellulose, hydroxypropyl cellulose and hydroxypropylmethyl cellulose; and naturally occurring polymers such as gelatin. Of these, polyvinyl alcohol and water-soluble cellulose derivatives are especially preferred.

In general, the dispersant is mixed with the organic silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The grain size (volume weighed mean diameter) of the solid particle dispersion of the organic silver salt obtained by the present invention may be determined by irradiating laser light, for example, to organic silver salt grains dispersed in liquid and determining the auto-correlation function of the fluctuation of scattering light relative to a time change. Preferably, the solid particle dispersion has a mean grain size of 0.05 $\mu$m to 10.0 $\mu$m, more preferably 0.1 $\mu$m to 5.0 $\mu$m, and most preferably 0.1 $\mu$m to 2.0 $\mu$m.

The grain size distribution of the organic silver salt is desirably monodisperse. Illustratively, the standard deviation of a volume weighed mean diameter divided by the volume weighed mean diameter, expressed in percent, which is a coefficient of variation, is preferably up to 80%, more preferably up to 50%, most preferably up to 30%.

The shape of the organic silver salt may be determined by observing a dispersion of the organic silver salt under a transmission electron microscope (TEM).

Reducing Agent

The photothermographic element according to the invention contains a reducing agent for the organic silver salt or silver ion. The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 5 to 50 mol %, more preferably 10 to 40 mol % per mol of silver on the image forming layer-bearing side. The reducing agent may be added to any layer on the image forming layer-bearing side. Where the reducing agent is added to a layer other than the image forming layer, the reducing agent should preferably be contained in a slightly greater amount of about 10 to 50 mol % per mol of silver. The reducing agent may take the form of a precursor which is modified so as to exert its effective function only at the time of development.

For photothermographic elements using organic silver salts, a wide range of reducing agents are disclosed, for example, in JP-A 6074/1971, 1238/1972, 33621/1972, 46427/1974, 115540/1974, 14334/1975, 36110/1975, 147711/1975, 32632/1976, 1023721/1976, 32324/1976, 51933/1976, 84727/1977, 108654/1980, 146133/1981, 82828/1982, 82829/1982, 3793/1994, U.S. Pat. Nos. 3,667,958, 3,679,426, 3,751,252, 3,751,255, 3,761,270, 3,782,949, 3,839,048, 3,928,686, 5,464,738, German Patent No. 2321328, and EP 692732. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl)-methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)-methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols and chromanols.

The reducing agent may be added in any desired form such as solution, powder or solid particle dispersion. The solid particle dispersion of the reducing agent may be prepared by well-known comminuting means such as ball mills, vibrating ball mills, sand mills, colloidal mills, jet mills, and roller mills. Dispersing aids may be used for facilitating dispersion.

Toner

A higher optical density is sometimes achieved when an additive known as a "toner" for improving images is contained. The toner is also sometimes advantageous in forming black silver images. The toner is preferably used in an amount of 0.1 to 50 mol %, especially 0.5 to 20 mol % per mol of silver on the image forming layer-bearing side. The toner may take the form of a precursor which is modified so as to exert its effective function only at the time of development.

For photothermographic elements using organic silver salts, a wide range of toners are disclosed, for example, in JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 99813/1977, 1020/1978, 76020/1978, 156524/1979, 156525/1979, 183642/1986, and 56848/1992, JP-B 10727/1974 and 20333/1979, U.S. Pat. Nos. 3,080,254, 3,446,648, 3,782,941, 4,123,282, 4,510,236, BP 1,380,795, and Belgian Patent No. 841,910. Examples of the toner include phthalimide and N-hydroxyphthalimide; cyclic imides such as succinimide, pyrazolin-5-one, quinazolinone, 3 -phenyl-2-pyrazolin-5-one, 1-phenylurazol, quinazoline and 2,4-thiazolidinedione; naphthalimides such as N-hydroxy-1,8-naphthalimide; cobalt complexes such as cobaltic hexammine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl) aryldicarboxyimides such as (N,N-dimethylaminomethyl) phthalimide and N,N-(dimethylaminomethyl)-naphthalene-2,3-dicarboxyimide; blocked pyrazoles, isothiuronium derivatives and certain photo-bleach agents such as N,N'-hexamethylenebis(1-carbamoyl-3,5-dimethylpyrazole), 1,8-(3,6-diazaoctane)bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(1-naphthyl) phthalazinone, 6-chlorophthalazinone, 5,7-dimethoxyphthalazinone and 2,3-dihydro-1,4-phthalazinedione; combinations of phthalazinones with phthalic acid derivatives (e.g., phthalic acid, 4-methylphthalic acid, 4-nitrophthalic acid and tetrachlorophthalic anhydride); phthalazine, phthalazine derivatives or metal salts such as 6-isopropylphthalazine, 6-methylphthalazine, 4-(1-naphthyl)phthalazine, 6-chlorophthalazine, 5,7-dimethoxyphthalazine, and 2,3-dihydrophthalazine; combinations of phthalazine or derivatives thereof with phthalic acid derivatives (e.g., phthalic acid, 4-methylphthalic acid, 4-nitrophthalic acid and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8 -methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

The toner may be added in any desired form, for example, as a solution, powder and solid particle dispersion. The solid particle dispersion of the toner is prepared by well-known finely dividing means such as ball mills, vibrating ball mills, sand mills, colloid mills, jet mills, and roller mills. Dispersing aids may be used in preparing the solid particle dispersion.

Polymer Latex

More benefits of the invention are obtained when the organic silver salt-containing layer is formed by coating a coating solution in which at least 30% by weight of the solvent is water and drying the coating, and especially when a latex of a polymer soluble or dispersible in an aqueous solvent, typically water solvent and having an equilibrium moisture content of up to 2% by weight at 25° C. and RH 60% (referred to as inventive polymer, hereinafter) is used as the binder of the organic silver salt-containing layer. In the most preferred embodiment, the polymer latex has been treated to an ionic conductivity of up to 2.5 mS/cm. For such treatment, a polymer after its synthesis is treated and purified with a separation functional membrane.

The "aqueous solvent" in which the inventive polymer is soluble or dispersible is water or a mixture of water and less than 70% by weight of a water-miscible organic solvent. Examples of the water-miscible organic solvent include alcohols such as methanol, ethanol, and propanol, cellosolves such as methyl cellosolve, ethyl cellosolve, and butyl cellosolve, and ethyl acetate and dimethylformamide. The term "aqueous solvent" is also applied to a system wherein a polymer is not thermodynamically dissolved, but dispersed.

The equilibrium moisture content (Weq) of a polymer at 25° C. and RH 60% is calculated according to the following expression:

$$Weq=(W1-W0)/W0\times 100\%$$

using the weight (W1) of the polymer conditioned in an atmosphere of 25° C. and RH 60% until equilibrium is reached and the weight (W0) of the polymer in an absolute dry condition at 25° C. With respect to the definition and measurement of an equilibrium moisture content, reference is made to Kobunshi Gakkai Ed., "Polymer Engineering Series 14—Polymeric Material Tests," Chijin Shokan K.K.

While the polymers used herein should preferably have an equilibrium moisture content of up to 2% by weight at 25° C. and RH 60%, the more preferred equilibrium moisture content is from 0.01 to 1.5% by weight, especially 0.02 to 1% by weight at 25° C. and RH 60%.

No further limits are imposed on the polymers used herein insofar as they are soluble or dispersible in the aqueous solvent and have an equilibrium moisture content of up to 2% by weight at 25° C. and RH 60%. Of these polymers, polymers dispersible in aqueous solvents are especially preferred.

With respect to the dispersed state, latexes in which fine particles of a solid polymer are dispersed and dispersions in which polymer molecules are dispersed in a molecular or micelle state are included.

One preferred embodiment of the invention uses hydrophobic polymers such as acrylic resins, polyester resins, rubbery resins (e.g., SBR resins), polyurethane resins, vinyl chloride resins, vinyl acetate resins, vinylidene chloride resins, and polyolefin resins. The polymers may be linear or branched or crosslinked. The polymers may be either homopolymers or copolymers having two or more monomers polymerized together. The copolymers may be either random copolymers or block copolymers. The polymers preferably have a number average molecule weight Mn of about 5,000 to about 1,000,000, more preferably about 10,000 to about 200,000. Polymers with a too lower molecular weight would generally provide emulsion layers with a low strength whereas polymers with a too higher molecular weight are difficult to form films.

The polymers used herein are dispersed in an aqueous dispersing phase. The aqueous phase is a dispersing phase containing at least 30% by weight of water. With respect to the dispersed state, a polymer emulsified in a dispersing medium, a micelle dispersion, and a polymer having a hydrophilic structure in a part of its molecule so that the molecular chain itself is dispersed on a molecular basis are included although polymer latexes are most preferred.

Illustrative preferred examples of the polymer are given below as P-1 to P-10, expressed by starting monomers, wherein numerical values in parentheses are % by weight and Mn is a number average molecular weight.

| Designation | Units | Mn |
|---|---|---|
| P-1 | -MMA(70)-EA(27)-MAA(3)-latex | 37,000 |
| P-2 | -MMA(70)-2EHA(20)-St(5)-AA(5)-latex | 40,000 |
| P-3 | -St(50)-Bu(47)-MAA(3)-latex | 45,000 |
| P-4 | -St(68)-Bu(29)-AA(3)-latex | 60,000 |
| P-5 | -St(70)-Bu(27)-IA(3)-latex | 120,000 |
| P-6 | -St(75)-Bu(24)-AA(1)-latex | 108,000 |
| P-7 | -St(60)-Bu(35)-DVB(3)-MAA(2)-latex | 150,000 |
| P-8 | -St(70)-Bu(25)-DVB(2)-AA(3)-latex | 280,000 |

-continued

| Designation | Units | Mn |
|---|---|---|
| P-9 | -VC(50)-MMA(20)-EA(20)-AN(5)-AA(5)-latex | 80,000 |
| P-10 | -VDC(85)-MMA(5)-EA(5)-MAA(5)-latex | 67,000 |

MMA: methyl methacrylate
EA: ethyl acrylate
MAA: methacrylic acid
2EHA: 2-ethylhexyl acrylate
St: styrene
Bu: butadiene AA: acrylic acid
DVB: divinyl benzene
VC: vinyl chloride
AN: acrylonitrile
VDC: vinylidene chloride
Et: ethylene
IA: itaconic acid These polymers are commercially available. Useful examples of the polymer which can be used herein include acrylic resins such as Sebian A-4635, 46583 and 4601 (Daicell Chemical K.K.) and Nipol Lx811, 814, 821, 820 and 857 (Nippon Zeon K.K.); polyester resins such as FINETEX ES650, 611, 675 and 850 (Dai-Nippon Ink & Chemicals K.K.) and WD-size and WMS (Eastman Chemical Products, Inc.); polyurethane resins such as HYDRAN AP10, 20, 30 and 40 (Dai-Nippon Ink & Chemicals K.K.); rubbery resins such as LACSTAR 7310K, 3307B, 4700H and 7132C (Dai-Nippon Ink & Chemicals K.K.) and Nipol Lx416, 410, 438C and 2507 (Nippon Zeon K.K.); vinyl chloride resins such as G351 and G576 (Nippon Zeon K.K.); vinylidene chloride resins such as L502 and L513 (Asahi Chemicals K.K.); and olefin resins such as Chemipearl S120 and SA100 (Mitsui Petro-Chemical K.K.). These polymers may be used in polymer latex form alone or in admixture of two or more.

The polymer latex used herein is preferably a latex of a styrene-butadiene copolymer. The styrene-butadiene copolymer preferably contains styrene monomer units and butadiene monomer units in a weight ratio of from 40:60 to 95:5. Also preferably the styrene-butadiene copolymer contains 60 to 99% by weight of styrene and butadiene monomer units combined. The preferred molecular weight range is as previously described. Preferred examples of the styrene-butadiene copolymer latex which is used herein are P-3 to P-8 in the above list, LACSTAR 3307B and 7132C, and Nipol Lx416.

In the preferred embodiment wherein a polymer latex is used in the organic silver salt-containing layer according to the invention, a hydrophilic polymer is added to the organic silver salt-containing layer if desired. Such hydrophilic polymers include gelatin, polyvinyl alcohol, methyl cellulose, and hydroxypropyl cellulose. The amount of the hydrophilic polymer added is more preferably up to 30%, especially up to 20% by weight of the entire binder in the organic silver salt-containing layer.

While the organic silver salt-containing layer according to the invention is preferably formed using the polymer latex as mentioned above, the content of the binder in the organic silver salt-containing layer is such that the weight ratio of entire binder to organic silver salt may range from 1/10 to 10/1, and especially from 1/5 to 4/1.

The organic silver salt-containing layer is typically a photosensitive layer (or emulsion layer) containing a photosensitive silver halide as the photosensitive silver salt. In this case, the weight ratio of the entire binder to silver halide ranges from 400/1 to 5/1 and especially from 200/1 to 10/1.

The total amount of the binder(s) in the image forming layer is preferably 0.2 to 30 g/m$^2$, more preferably 1 to 15

$g/m^2$. Additionally, crosslinking agents for crosslinking and surfactants for ease of application may be added to the image forming layer coating solution.

The solvent of the coating solution from which the organic silver salt-containing layer of the photothermographic element according to the invention is formed (for simplicity's sake, the term solvent is used as a mixture of a solvent and a dispersing medium) is an aqueous solvent containing at least 30% by weight of water. The component other than water may be any of water-miscible organic solvents such as methyl alcohol, ethyl alcohol, isopropyl alcohol, methyl cellosolve, ethyl cellosolve, dimethylformamide and ethyl acetate. The solvent of the coating solution should more preferably contain at least 50%, further preferably at least 70% by weight of water. Exemplary solvent mixtures are a 90/10 mixture of water/methyl alcohol, a 70/30 mixture of water/methyl alcohol, a 80/15/5 mixture of water/methyl alcohol/dimethylformamide, a 85/10/5 mixture of water/methyl alcohol/ethyl cellosolve, and a 85/10/5 mixture of water/methyl alcohol/isopropyl alcohol, all expressed in a weight ratio.

Antifoggant

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in BP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Preferred antifoggants are organic halides, for example, the compounds described in JP-A 119624/1975, 120328/1975, 121332/1976, 58022/1979, 70543/1981, 99335/1981, 90842/1984, 129642/1986, 129845/1987, 208191/1994, 5621/1995, 2781/1995, 15809/1996, U.S. Pat. Nos. 5,340,712, 5,369,000, and 5,464,737.

The antifoggant may be added in any desired form such as solution, powder or solid particle dispersion. The solid particle dispersion of the antifoggant may be prepared by well-known comminuting means such as ball mills, vibrating ball mills, sand mills, colloidal mills, jet mills, and roller mills. Dispersing aids may be used for facilitating dispersion.

It is sometimes advantageous to add a mercury (II) salt to an emulsion layer as an antifoggant though not necessary in the practice of the invention. Mercury (II) salts preferred to this end are mercury acetate and mercury bromide. The mercury (II) salt is preferably added in an amount of $1\times10^{-9}$ mol to $1\times10^{-3}$ mol, more preferably $1\times10^{-8}$ mol to $1\times10^{-4}$ mol per mol of silver coated.

Still further, the photothermographic element of the invention may contain a benzoic acid type compound for the purposes of increasing sensitivity and restraining fog. Any of benzoic acid type compounds may be used although examples of the preferred structure are described in U.S. Pat. Nos. 4,784,939 and 4,152,160, Japanese Patent Application Nos. 98051/1996, 151241/1996, and 151242/1996. The benzoic acid type compound may be added to any site in the photosensitive element, preferably to a layer on the same side as the photosensitive layer, and more preferably an organic silver salt-containing layer. The benzoic acid type compound may be added at any step in the preparation of a coating solution. Where it is contained in an organic silver salt-containing layer, it may be added at any step from the preparation of the organic silver salt to the preparation of a coating solution, preferably after the preparation of the organic silver salt and immediately before coating. The benzoic acid type compound may be added in any desired form including powder, solution and fine particle dispersion. Alternatively, it may be added in a solution form after mixing it with other additives such as a sensitizing dye, reducing agent and toner. The benzoic acid type compound may be added in any desired amount, preferably $1\times10^{-6}$ to 2 mol, more preferably $1\times10^{-3}$ to 0.5 mol per mol of silver.

In the element of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—S—M and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

In the photosensitive layer, polyhydric alcohols (e.g., glycerin and diols as described in U.S. Pat. No. 2,960,404), fatty acids and esters thereof as described in U.S. Pat. Nos. 2,588,765 and 3,121,060, and silicone resins as described in BP 955,061 may be added as a plasticizer and lubricant.

Protective Layer

According to the present invention, a protective layer is preferably formed on the image forming layer for the purpose of preventing the image forming layer from sticking.

Any desired polymer may be used as the binder in the protective layer although the layer preferably contains 100 $mg/m^2$ to 5 $g/m^2$ of a polymer having a carboxylic acid residue. The polymers having a carboxylic acid residue include natural polymers (e.g., gelatin and alginic acid), modified natural polymers (e.g., carboxymethyl cellulose and phthalated gelatin), and synthetic polymers (e.g., polymethacrylate, polyacrylate, polyalkyl methacrylate/acrylate copolymers, and polystyrene/polymethacrylate copolymers). The content of the carboxylic acid residue is preferably $1\times10^{-2}$ to 1.4 mol per 100 grams of the polymer. The carboxylic acid residue may form a salt with an alkali metal ion, alkaline earth metal ion or organic cation.

In the surface protective layer, any desired anti-sticking material may be used. Examples of the anti-sticking material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof. Crosslinking agents for crosslinking, surfactants for ease of application, and other addenda are optionally added to the surface protective layer.

In the image forming layer or a protective layer therefor according to the invention, there may be used light absorbing substances and filter dyestuffs as described in U.S. Pat. Nos. 3,253,921, 2,274,782, 2,527,583, and 2,956,879. The dyestuffs may be mordanted as described in U.S. Pat. No. 3,282,699. The filer dyestuffs are used in such amounts that the layer may have an absorbance of 0.1 to 3, especially 0.2 to 1.5 at the exposure wavelength.

The image forming layer or a protective layer therefor of the element of the invention may contain a matte agent such as starch, titanium dioxide, zinc oxide, silica, and polymeric beads including beads of the type described in U.S. Pat. Nos. 2,992,101 and 1,701,245. The emulsion layer side may have any degree of matte insofar as no star dust failures occur although a Bekk smoothness of 200 to 10,000 seconds, especially 300 to 10,000 seconds is preferred.

In one preferred embodiment, the photothermographic element of the invention is a one-side photothermographic element having at least one photosensitive layer containing a silver halide emulsion on one side and a back layer on the other side of the support.

In the one-side photothermographic element of the invention, a matte agent may be added for improving transportation. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 μm to 30 μm are preferably used in the practice of the invention. The particle size distribution of the matte agent may be either narrow or wide. Nevertheless, since the haze and surface luster of coating are largely affected by the matte agent, it is preferred to adjust the particle size, shape and particle size distribution of a matte agent as desired during preparation of the matte agent or by mixing plural matte agents.

The back layer should preferably have a degree of matte as expressed by a Bekk smoothness of 10 to 250 seconds, more preferably 50 to 180 seconds.

In the element of the invention, the matte agent is preferably contained in an outermost surface layer, a layer functioning as an outermost surface layer, a layer close to the outer surface or a layer functioning as a so-called protective layer.

Since no contents are removed from the photothermographic element by heat development, the sticking of developed images can become a problem. From this standpoint, it is preferred to incorporate a matte agent of greater size. Specifically, it is preferred that a matte agent having a ean particle size of 1 to 8 μm be contained on the same side as the photosensitive layer and a gamma value of 2 to 65 be obtained after heat development because an acceptable compromise is established between sticking and the visual perceptibility of characters and numerals. It is noted that the gamma value is calculated as E2/E1 wherein E1 is an exposure energy for providing a density of Dmin+0.1 after heat development and E2 is an exposure energy for providing a density of Dmin+2.8 after heat development. The preferred gamma value is in the range of 10 to 50, and the preferred size of the matte agent is from 2 to 6 μm. The matte agent may have a narrow or wide particle size distribution. Nevertheless, since the haze and surface luster of coating are largely affected by the matte agent, it is preferred to adjust the particle size, shape and particle size distribution of a matte agent as desired during preparation of the matte agent or by mixing plural matte agents.

The amount of the matte agent coated is preferably 1 to 400 $mg/m^2$, more preferably 5 to 300 $mg/m^2$. Most preferably, matte agent particles having a size of 4 μm or greater are coated in an amount of 5 to 150 $mg/m^2$.

In the practice of the invention, the binder used in the back layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, polyvinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

The back layer preferably exhibits a maximum absorbance of 0.3 to 2, more preferably 0.5 to 2 in the predetermined wavelength range and an absorbance of 0.001 to less than 5 in the visible range after processing. Further preferably, the back layer has an optical density of 0.001 to less than 0.3. Examples of the antihalation dye used in the back layer are the same as previously described for the antihalation layer.

A backside resistive heating layer as described in U.S. Pat. Nos. 4,460,681 and 4,374,921 may be used in a photothermographic imaging system according to the present invention.

According to the invention, a hardener may be used in various layers including a photosensitive layer, protective layer, and back layer. Illustrative hardeners are described in James, "The Theory of the Photographic Process," Fourth Edition, Macmillan Publishing Co., Inc., 1977, pages 77–87. The preferred hardeners include polyvalent metal ions described on page 78 of the same, polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

The hardener is added in solution form. The time when the hardener is added to a protective layer coating solution is preferably from 180 minutes before coating to immediately before coating, more preferably from 60 minutes before coating to 10 seconds before coating. The mixing method and conditions are not particularly limited insofar as the benefits of the invention are fully achievable. Illustrative mixing methods include a method of mixing in a tank such that the average residence time calculated from a flow rate of addition and a delivery rate to a coater may be as desired and a mixing method using the static mixer described in N. Harnby, F. Edwards and A. W. Nienow (translator Takahashi), Liquid Mixing Technology, Nikkan Kogyo Shinbun, 1989, Chap. 8.

A surfactant may be used for the purposes of improving coating and electric charging properties. The surfactants used herein may be nonionic, anionic, cationic and fluorinated ones. Examples include fluorinated polymer surfactants as described in JP-A 170950/1987 and U.S. Pat. No. 5,380,644, fluorochemical surfactants as described in JP-A 244945/1985 and 188135/1988, polysiloxane surfactants as described in U.S. Pat. No. 3,885,965, and polyalkylene oxide and anionic surfactants as described in JP-A 301140/1994.

Examples of the solvent used herein are described in "New Solvent Pocket Book," Ohm K.K., 1994, though not limited thereto. The solvent used herein should preferably have a boiling point of 40 to 180° C. Exemplary solvents include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine, and water.

Support

According to the invention, the thermographic photographic emulsion may be coated on a variety of supports. Typical supports include polyester film, subbed polyester film, poly(ethylene terephthalate) film, polyethylene naphthalate film, cellulose nitrate film, cellulose ester film, poly (vinyl acetal) film, polycarbonate film and related or resinous materials, as well as glass, paper, metals, etc. Often used are flexible substrates, typically paper supports, specifically baryta paper and paper supports coated with partially acetylated α-olefin polymers, especially polymers of α-olefins having 2 to 10 carbon atoms such as polyethylene, polypropylene, and ethylene-butene copolymers. The supports are either transparent or opaque, preferably transparent.

The photothermographic element of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

A method for producing color images using the photothermographic material of the invention is as described in JP-A 13295/1995, page 10, left column, line 43 to page 11, left column, line 40. Stabilizers for color dye images are exemplified in BP 1,326,889, U.S. Pat. Nos. 3,432,300, 3,698,909, 3,574,627, 3,573,050, 3,764,337, and 4,042,394.

In the practice of the invention, the photothermographic emulsion can be applied by various coating procedures including extrusion coating, slide coating, curtain coating, dip coating, knife coating, flow coating, and extrusion coating using a hopper of the type described in U.S. Pat. No. 2,681,294. The coating techniques recommended in the invention are described in Stephan F. Kistler and Peter M. Schweizer, LIQUID FILM COATING, CHAPMA & HALL, 1997, pp. 399–734, and more preferably, extrusion coating and slide coating. Slide coating is most preferable. Of the coating machines used in these coating techniques, one exemplary slide coater is shown in FIG. 11*b*.1 on page 427. If desired, two or more layers may be concurrently coated by the methods described on pages 399–536 and in U.S. Pat. No. 2,761,791 and BP 837,095.

In the photothermographic element of the invention, there may be contained additional layers, for example, a dye accepting layer for accepting a mobile dye image, an opacifying layer when reflection printing is desired, a protective topcoat layer, and a primer layer well known in the photothermographic art. The photosensitive element of the invention is preferably such that only a single sheet of the photosensitive element can form an image. That is, it is preferred that a functional layer necessary to form an image such as an image receiving layer does not constitute a separate member.

The photosensitive element of the invention may be developed by any desired method although it is generally developed by heating after imagewise exposure. The preferred developing temperature is about 80 to 250° C., more preferably 100 to 140° C. The preferred developing time is about 1 to 180 seconds, more preferably about 10 to 90 seconds.

Any desired technique may be used for the exposure of the photothermographic element of the invention. The preferred light source for exposure is a laser, for example, a gas laser, YAG laser, dye laser or semiconductor laser. A semiconductor laser combined with a second harmonic generating device is also useful.

Upon exposure, the photosensitive element of the invention tends to generate interference fringes due to low haze. Known techniques for preventing generation of interference fringes are a technique of obliquely directing laser light to a photosensitive element as disclosed in JP-A 113548/1993 and the utilization of a multi-mode laser as disclosed in WO 95/31754. These techniques are preferably used herein.

Upon exposure of the photothermographic element of the invention, exposure is preferably made by overlapping laser light so that no scanning lines are visible, as disclosed in SPIE, Vol. 169, Laser Printing 116–128 (1979), JP-A 51043/1992, and WO 95/31754.

EXAMPLE

Examples of the invention are given below by way of illustration and not by way of limitation.

Example 1

PET Support

Using terephthalic acid and ethylene glycol, a polyethylene terephthalate (PET) having an intrinsic viscosity of 0.66 as measured in a phenol/tetrachloroethane 6/4 (weight ratio) mixture at 25° C. was prepared in a conventional manner. After the PET was pelletized and dried at 130° C. for 4 hours, it was melted at 300° C., extruded through a T-shaped die, and quenched to form an unstretched film having a thickness sufficient to give a thickness of 175 μm after thermosetting.

The film was longitudinally stretched by a factor of 3.3 by means of rollers rotating at different circumferential speeds and then transversely stretched by a factor of 4.5 by means of a tenter. The temperatures in these stretching steps were 110° C. and 130° C., respectively. Thereafter, the film was thermoset at 240° C. for 20 seconds and then transversely relaxed 4% at the same temperature. Thereafter, with the chuck of the tenter being slit and the opposite edges being knurled, the film was taken up under a tension of 4.8 kg/cm$^2$. In this way, a film of 175 μm thick was obtained in a roll form.

Using a solid state corona treating apparatus model 6KVA by Pillar Co., the support on both surfaces was treated with a corona discharge at room temperature while feeding the support at a speed of 20 m/min. It was determined from the readings of current and voltage that the support was treated at 0.375 kV·A·min/m$^2$. The operating frequency was 9.6 kHz and the gap clearance between the electrode and the dielectric roll was 1.6 mm.

Subbed Support

Undercoat Coating Solution A

An undercoat coating solution A was prepared by adding 1 g of polystyrene microparticulates having a mean particle size of 0.2 μm and 20 ml of a 1 wt % solution of Surfactant-1 to 200 ml of a 30 wt % water dispersion of a polyester copolymer Pesresin A-515GB (Takamatsu Yushi K.K.). Distilled water was added to a total volume of 1,000 ml.

Undercoat Coating Solution B

An undercoat coating solution B was prepared by adding 200 ml of a 30 wt % water dispersion of a styrene-butadiene copolymer (styrene/butadiene/itaconic acid=47/50/3 in weight ratio) and 0.1 g of polystyrene microparticulates having a mean particle size of 2.5 μm to 680 ml of distilled water. Distilled water was added to a total volume of 1,000 ml.

Undercoat Coating Solution C

An undercoat coating solution C was prepared by dissolving 10 g of inert gelatin in 500 ml of distilled water and adding thereto 40 g of a 40 wt % water dispersion of tin oxide-antimony oxide composite microparticulates as described in JP-A 20033/1986. Distilled water was added to a total volume of 1,000 ml.

Subbed Support

After the corona discharge treatment described above, the undercoat coating solution A was applied to the support by means of a bar coater in a wet coverage of 5 ml/m$^2$, followed by drying at 180° C. for 5 minutes. The undercoat layer had a dry thickness of about 0.3 μm. Next, the support was subject to corona discharge treatment on the back surface thereof. On the treated back surface, the undercoat coating solution B was applied by means of a bar coater in a wet coverage of 5 ml/m$^2$, followed by drying at 180° C. for 5 minutes to form a back undercoat having a dry thickness of about 0.3 μm. Further, the undercoat coating solution C was applied onto the back undercoat by means of a bar coater in a wet coverage of 3 ml/m$^2$, followed by drying at 180° C. for 5 minutes to form a second back undercoat having a dry thickness of about 0.03 μm. The subbed support was completed in this way.

Preparation of Organic Acid Silver Dispersion

While a mixture of 43.8 g of behenic acid (trade name Edenor C22-85R, by Henkel AG), 730 ml of distilled water, and 60 ml of tert-butanol was stirred at 79° C., 117 ml of 1N NaOH aqueous solution was added over 55 minutes, and reaction was continued for 240 minutes. Next, 112.5 ml of an aqueous solution containing 19.2 g of silver nitrate was added over 45 seconds to the solution, which was left to stand for 20 minutes and cooled to 30° C. Thereafter, the solids were separated by suction filtration and washed with water until the water filtrate reached a conductivity of 30 μS/cm. The thus obtained solids were handled as a wet cake without drying. To 100 g as dry solids of the wet cake, 7.4 g of polyvinyl alcohol PVA-205 (Kurare K.K.) and water were added to a total weight of 385 g. This was pre-dispersed in a homomixer.

The pre-dispersed liquid was processed three times by a dispersing machine Micro-Fluidizer M-110S-EH (with G10Z interaction chamber, manufactured by Microfluidex International Corporation) which was operated under a pressure of 1,750 kg/m$^2$. There was obtained a silver behenate dispersion B. The silver behenate grains in this dispersion were acicular grains having a mean minor axis (or breadth) of 0.04 μm, a mean major axis (or length) of 0.8 μm, and a coefficient of variation of 30%. It is noted that particle dimensions were measured by Master Sizer X (Malvern Instruments Ltd.). The desired dispersion temperature was set by mounting serpentine heat exchangers at the front and rear sides of the interaction chamber and adjusting the temperature of refrigerant.

Dispersion of Reducing Agent

Water, 176 g, was added to 80 g of 1,1-bis(2 -hydroxy-3,5-dimethylphenyl)-3,5,5-trimethylhexane and 64 g of a 20% aqueous solution of modified polyvinyl alcohol MP-203 (Kurare K.K.). They were thoroughly agitated to form a slurry. A vessel was charged with the slurry together with 800 g of zirconia beads having a mean diameter of 0.5 mm. A dispersing machine ¼G Sand Grinder Mill (Imex K.K.) was operated for 5 hours for dispersion, obtaining a 25% solid particle dispersion of the reducing agent. The reducing agent particles in the dispersion had a mean diameter of 0.72 μm.

Dispersion of Mercapto Compound

Water, 224 g, was added to 64 g of 3-mercapto-4-phenyl-5-heptyl-1,2,4-triazole and 32 g of a 20% aqueous solution of modified polyvinyl alcohol MP-203 (Kurare K.K.). They were thoroughly agitated to form a slurry. A vessel was charged with the slurry together with 800 g of zirconia beads having a mean diameter of 0.5 mm. A dispersing machine ¼G Sand Grinder Mill (Imex K.K.) was operated for 10 hours for dispersion, obtaining a 20% solid particle dispersion of the mercapto compound. The mercapto compound particles in the dispersion had a mean diameter of 0.67 μm.

Dispersion of Organic Polyhalide

Water, 224 g, was added to 48 g of tribromomethylphenylsulfone, 48 g of 3-tribromomethylsulfonyl-4-phenyl-5-tridecyl-1,2,4-triazole, and 48 g of a 20% aqueous solution of modified polyvinyl alcohol MP-203 (Kurare K.K.). They were thoroughly agitated to form a slurry. A vessel was charged with the slurry together with 800 g of zirconia beads having a mean diameter of 0.5 mm. A dispersing machine ¼G Sand Grinder Mill (Imex K.K.) was operated for 5 hours for dispersion, obtaining a 30% solid particle dispersion of the polyhalide. The polyhalide particles in the dispersion had a mean diameter of 0.74 μm.

Methanol Solution of Phthalazine 26 g of 6-isopropylphthalazine was dissolved in 100 ml of methanol.

Dispersion of Pigment

Water, 250 g, was added to 64 g of C. I. Pigment Blue and 6.4 g of Demol N (Kao K.K.). They were thoroughly agitated to form a slurry. A vessel was charged with the slurry together with 800 g of zirconia beads having a mean diameter of 0.5 mm. A dispersing machine ¼G Sand Grinder Mill (Imex K.K.) was operated for 25 hours for dispersion, obtaining a 20% solid particle dispersion of the pigment. The pigment particles in the dispersion had a mean diameter of 0.21 μm.

Silver Halide Grains-1

A solution was obtained in a titanium-lined stainless steel reactor by adding 6.7 ml of a 1 wt % potassium bromide solution to 1421 ml of distilled water, and further adding 8.2 ml of 1N nitric acid and 8 g of phthalated gelatin. In the reactor, the solution was stirred and maintained at 30° C. There were furnished a solution (al) of 37.04 g of silver nitrate diluted with distilled water to a volume of 159 ml and a solution (b1) of 32.6 g of potassium bromide diluted with distilled water to a volume of 200 ml. The entirety of solution (a1) was added at a constant flow rate over one minute by the controlled double jet method while maintaining the solution at pAg 8.1. (Solution (b1) was added by the controlled double jet method.) Thereafter, 30 ml of a 3.5% hydrogen peroxide aqueous solution was added and 36 ml of a 3 wt % benzimidazole aqueous solution added. There were further furnished a solution (a2) obtained by diluting solution (a1) with distilled water to a volume of 317.5 ml and a solution (b2) obtained by dissolving tripotassium hexachloroiridate to solution (b1) so as to finally become $1\times10^{-4}$ mol per mol of silver, and diluting with distilled water to a volume of 400 ml, that is twice the volume of solution (b1). The entirety of solution (a2) was added at a constant flow rate over 10 minutes yet by the controlled double jet method while maintaining the solution at pAg 8.25. (Solution (b2) was added by the controlled double jet method.) Thereafter, 50 ml of a 0.5% methanol solution of 2-mercapto-5-methylbenzimidazole was added to the dispersion, which was adjusted to pAg 7.5 with silver nitrate and then to pH 3.8 with 1N sulfuric acid. Agitation was stopped at this point. After flocculation, desalting, and water washing, 3.5 g of deionized gelatin was added and 1N sodium hydroxide added. Adjustment to pH 6.0 and pAg 8.2 at 40° C. yielded a silver halide dispersion.

The grains in this silver halide emulsion were pure silver bromide grains having a mean equivalent spherical diameter of 0.022 μm and a coefficient of variation of equivalent spherical diameter of 20%. The grain size was determined from an average of 100 grains in a photomicrograph. The grains had a {100} face proportion of 75% as determined by Kubelka-Munk method.

The emulsion was heated at 50° C. with stirring, to which 5 ml of a 0.5 wt % methanol solution of N,N'-dihydroxy-N",N"-diethylmelamine and 5 ml of a 3.5 wt % methanol solution of phenoxyethanol were added, and after one minute, $3\times10^{-5}$ mol per mol of silver of sodium benzenethiosulfonate was added. After 2 minutes, $5\times10^{-3}$ mol per mol of silver of a solid dispersion of Spectral Sensitizing Dye A (in gelatin aqueous solution) was added. After 2 minutes, $5\times10^{-5}$ per mol of silver of Tellurium Sensitizer B was further added to the emulsion, which was ripened for 50 minutes. Nearly the end of ripening, $1\times10^{-3}$ mol per mol of silver of 2-mercapto-5-methylbenzimidazole was added. The emulsion was cooled to terminate chemical sensitization, obtaining Silver Halide Grains-1 or Emulsion 1.

Emulsions 2 to 5 as shown in Table 1 were prepared as was Emulsion 1 except that the grain size was changed by changing the liquid temperature during grain formation, and the amounts of the chemical sensitizer and sensitizing dye were adjusted so as to give an optimum sensitivity in the sensitometry to be described later. Emulsions 6 to 10 corresponding to Emulsions 1 to 5 were similarly prepared except that the sensitizing dye was added after the chemical sensitization. Emulsion 3 had a {100} face proportion of 83%.

TABLE 1

| Emulsion No. | Grain size | Coefficient of variation | Dye added before or after chemical sensitization |
|---|---|---|---|
| 1 invention | 0.022 μm | 20% | before |
| 2 invention | 0.030 μm | 17% | before |
| 3 invention | 0.045 μm | 13% | before |
| 4 comparison | 0.060 μm | 11% | before |
| 5 comparison | 0.080 μm | 9% | before |
| 6 comparison | 0.022 μm | 20% | after |
| 7 comparison | 0.030 μm | 17% | after |
| 8 comparison | 0.045 μm | 13% | after |
| 9 comparison | 0.060 μm | 11% | after |
| 10 comparison | 0.080 μm | 9% | after |

Emulsion Layer Coating Solution

Emulsion layer coating solution No. 1 was prepared by mixing 103 g of the organic acid silver dispersion with 5 g of a 20 wt % aqueous solution of polyvinyl alcohol PVA-205 (Kurare K.K.). To the mixture kept at 40° C. were added 23.2 g of the 25% reducing agent dispersion, 4.8 g of the 20% pigment water dispersion (C. I. Pigment Blue 60), 10.7 g of the 30% organic polyhalide dispersion, and 3.1 g of the 20% mercapto compound dispersion.

Thereafter, 106 g of a 40 wt % SBR latex which had been purified by ultrafiltration and kept at 40° C. was added to the solution. After thorough agitation, 6 ml of the methanol solution of phthalazine was added, obtaining an organic acid silver-containing liquid. Each of Silver Halide Grains-1 to 10 was previously thoroughly agitated and mixed with the organic acid silver-containing liquid immediately before coating by means of a static mixer, obtaining the emulsion layer coating solution. This solution was delivered to a coating die so as to provide a silver coverage of 1.4 g/m$^2$. Of this silver coverage, the silver halide accounted for a fraction of 0.1 g/m$^2$.

The emulsion layer coating solution had a viscosity of 85 mpa·s at 40° C. as measured by a B type viscometer by Tokyo Keiki K.K. When measured at 25° C. with a RFS fluid spectrometer by Rheometrics Far East K.K., the coating solution had a viscosity of 1500, 220, 70, 40, and 20 mpa·s at a shear rate of 0.1, 1, 10, 100, and 1000 $s^{-1}$, respectively.

It is noted that the SBR latex was purified by ultrafiltration as follows. The SBR latex used was a latex of SBR polymer—St(68)-Bu(29)-AA(3)—having a mean particle size of 0.1 μm, a concentration of 45%, an ionic conductivity of 4.2 mS/cm (as measured on a 40% latex stock liquid at 25° C. by a conductivity meter CM-30S by Toa Denpa Kogyo K.K.), and pH 8.2. A dilution of the SBR latex with distilled water by a factor of 10 was dilution purified through an ultrafiltration purifying module FS03-FC-FUY03A1 (Daisen Membrane System K.K.) until an ionic conductivity of 1.5 mS/cm was reached. The latex concentration was 40%.

Emulsion Side Intermediate Layer Coating Solution

To 772 g of a 10 wt % aqueous solution of polyvinyl alcohol PVA-205 (Kurare K.K.) and 226 g of a 27.5% latex of a methyl methacrylate/styrene/2-ethylhexyl acrylate/hydroxyethyl methacrylate/acrylic acid copolymer (copolymerization weight ratio 59/9/26/5/1) were added 2 ml of a 5 wt % aqueous solution of Aerosol OT (American Cyanamid Co.), 4 g of benzyl alcohol, 1 g of 2,2,4-trimethyl-1,3-pentane diol monoisobutyrate, and 10 mg of benzisothiazolinone. The resulting intermediate layer coating solution was delivered to the coating die so as to give a coverage of 5 ml/$m^2$.

This coating solution had a viscosity of 21 mpa·s at 40° C. as measured by the B type viscometer.

Emulsion Side First Protective Layer Coating Solution

A first protective layer coating solution was prepared by dissolving 80 g of inert gelatin in water, adding thereto 138 ml of a 10% methanol solution of phthalic acid, 28 ml of 1N sulfuric acid, 5 ml of a 5 wt % aqueous solution of Aerosol OT (American Cyanamid Co.), and 1 g of phenoxyethanol, and adding water so as to give a total weight of 1000 g. The coating solution was delivered to the coating die so as to give a coverage of 10 ml/$m^2$.

This coating solution had a viscosity of 17 mpa·s at 40° C. as measured by the B type viscometer.

Emulsion Side Second Protective Layer Coating Solution

A second protective layer coating solution was prepared by dissolving 100 g of inert gelatin in water, adding thereto 20 ml of a 5% solution of potassium salt of N-perfluorooctylsulfonyl-N-propylalanine, 16 ml of a 5 wt % aqueous solution of Aerosol OT (American Cyanamid Co.), 25 g of polymethyl methacrylate microparticulates having a mean particle diameter of 4.0 μm, 44 ml of 1N sulfuric acid, and 10 mg of benzisothiazolinone, and adding water so as to give a total weight of 1555 g. This was mixed with 445 ml of an aqueous solution containing 4 wt % of chromium alum and 0.67 wt % of phthalic acid immediately before coating by means of a static mixer. The protective layer coating solution was delivered to the coating die so as to give a coverage of 10 ml/$m^2$.

This coating solution had a viscosity of 9 mPa·s at 40° C. as measured by the B type viscometer.

Back Side Coating Solution

Solid Particle Dispersion of Base Precursor

Distilled water, 246 ml, was mixed with 64 g of a base precursor and 10 g of a surfactant Demol N (Kao K.K.). The mixture was dispersed with beads in a sand mill (¼ gallon Sand Grinder Mill by Imex K.K.). The resulting solid particle dispersion of the base precursor had a mean particle diameter of 0.2 μm.

Solid Particle Dispersion of Dye

Distilled water, 305 ml, was mixed with 9.6 g of a cyanine dye compound and 5.8 g of sodium p-alkylbenzenesulfonate. The mixture was dispersed with beads in a sand mill (¼ gallon Sand Grinder Mill by Imex K.K.). The resulting solid particle dispersion of the dyestuff had a mean particle diameter of 0.2 μm.

Antihalation Layer Coating Solution

An antihalation layer coating solution was prepared by mixing 17 g of gelatin, 9.6 g of polyacrylamide, 70 g of the solid particle dispersion of the base precursor, 56 g of the solid particle dispersion of the dyestuff, 1.5 g of polymethyl methacrylate microparticulates having a mean particle size of 6.5 μm, 2.2 g of sodium polyethylenesulfonate, 0.2 g of a 1% aqueous solution of a coloring dyestuff, and 844 ml of $H_2O$.

Protective Layer Coating Solution

A protective layer coating solution was prepared in a vessel kept at 40° C., by mixing 50 g of gelatin, 0.2 g of sodium polystyrenesulfonate, 2.4 g of N,N'-ethylene-bis (vinylsulfonacetamide), 1 g of sodium t-octylphenoxyethoxyethanesulfonate, 30 mg of benzisothiazolinone, 32 mg of $C_8F_{17}SO_3K$, 64 mg of $C_8F_{17}SO_2N(C_3H_7)(CH_2CH_2O)_4(CH_2)_4—SO_3Na$, and 950 ml of $H_2O$.

Several substances used are shown below by the structural formulae.

Spectral Sensitizing Dye A

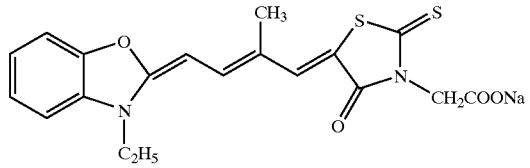

Tellurium Sensitizer B

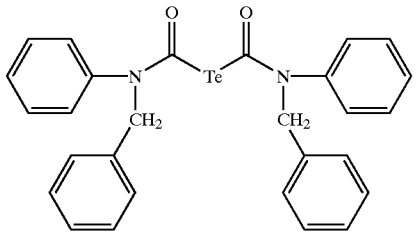

Surfactant-1

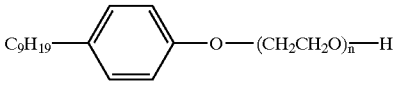

n ≈ 8.5

Base Precursor

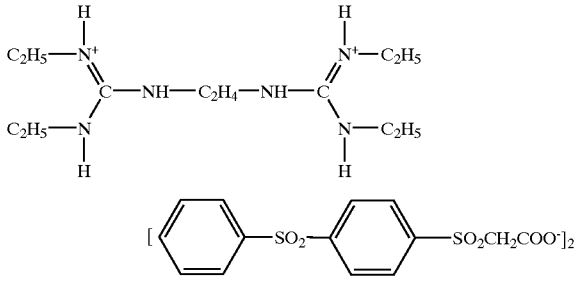

-continued

Cyanine Dye Compound

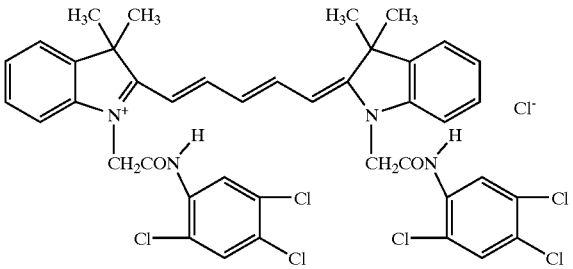

Coloring Dyestuff

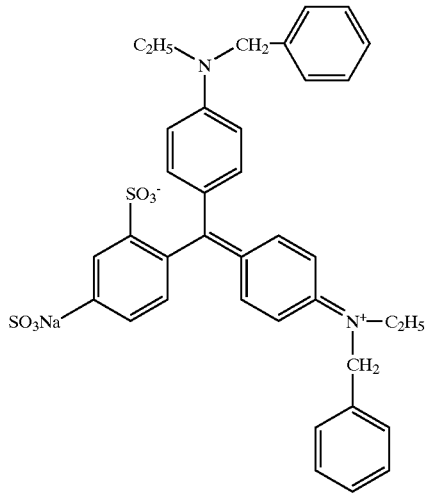

Photothermographic Element

Onto the subbed support, the antihalation layer coating solution and the protective layer coating solution were simultaneously applied in a multiple or overlapping manner so that the amount of solid microparticulate dyestuff coated (from the former solution) was 0.4 g/m$^2$ and the amount of gelatin coated (from the latter solution) was 1 g/m$^2$. On drying, an antihalation back layer was formed. Onto the side of the support opposite to the back side, the emulsion layer, intermediate layer, first protective layer, and second protective layer were simultaneously applied in a multiple or overlapping manner in this order from the subbed surface by the slide bead coating method. A photothermographic element sample was prepared in this way. It is noted that after the back side was coated, the emulsion side was coated without winding the film into a roll.

Coating was effected at a speed of 160 m/min. The spacing between the tip of the coating die and the support was set to 0.18 mm. The pressure in a vacuum chamber was lower than the atmospheric pressure by 392 Pa. In the subsequent chilling zone, air having a dry bulb temperature of 18° C. and a wet bulb temperature of 12° C. was blown at an average wind velocity of 7 m/sec for 30 seconds for cooling the coating solution. In a drying zone of the spiral float system, drying air having a dry bulb temperature of 30° C. and a wet bulb temperature of 18° C. was blown through an aperture at a wind velocity of 20 m/sec for 20 seconds for volatilizing off the solvent from the coating solution.

Photographic Properties

The photographic element sample was exposed to light at an angle of 30° relative to a normal by means of a 647-nm Kr laser sensitometer (maximum power 500 mW) and heated at 120° C. for 15 seconds for development whereupon the image was examined by means of a densitometer. The results of measurement were evaluated in terms of Dmin and sensitivity. The sensitivity (S) is a reciprocal of a ratio of an exposure dose providing a density of Dmin plus 1.0 and expressed in a relative value based on a sensitivity of 100 for photographic element sample No. 1.

The results are shown in Table 2.

TABLE 2

| Photographic sample No. | Emulsion | S | Fog | Dmax |
|---|---|---|---|---|
| 1 | 1 | 120 | 0.16 | 3.7 |
| 2 | 2 | 250 | 0.16 | 3.6 |
| 3 | 3 | 430 | 0.17 | 3.5 |
| 4 | 4 | 530 | 0.20 | 2.9 |
| 5 | 5 | 600 | 0.23 | 2.1 |
| 6 | 6 | 10 | 0.18 | 3.5 |
| 7 | 7 | 30 | 0.19 | 3.2 |
| 8 | 8 | 100 | 0.21 | 3.1 |
| 9 | 9 | 330 | 0.21 | 2.9 |
| 10 | 10 | 500 | 0.23 | 2.2 |

Note that fog is the density of unexposed area.

It is seen from Table 2 that in the region of ultrafine grain diameter of up to 50 nm, the inventive samples show a low fog, high relative sensitivity and high maximum density as compared with the comparative samples.

Example 2

A photothermographic element sample No. 11 having a substantially equivalent sensitivity and maximum density to sample No. 1 was prepared in the same manner as sample No. 8 of Example 1 except that the coverage of silver halide was increased to 0.17 g/m$^2$ of silver. Also, a photothermographic element sample No. 12 having a substantially equivalent sensitivity and maximum density to sample No. 3 was prepared in the same manner as sample No. 9 of Example 1 except that the coverage of silver halide was increased to 0.25 g/m$^2$ of silver.

Image Retention Against Illumination

After a photothermographic element sample was exposed and developed as in the photographic test, it was rested for 10 days on a view box illuminated at a luminance of 1000 lux. The illuminated image was visually observed and rated according to the following criterion.

Excellent: little change

Good: slight color change, but inoffensive

Fair: discolored image areas, but practically acceptable

Poor: discolored Dmin areas with increased density, unacceptable

The results are shown in Table 3.

TABLE 3

| Sample No. | Visual rating |
|---|---|
| 1 | Excellent |
| 3 | Excellent |
| 8 | Good |
| 9 | Good |
| 11 | Poor |
| 12 | Poor |

It is evident from Table 3 that the photothermographic element samples within the scope of the invention are improved in image retention against light illumination when they are formulated to the desired sensitivity and maximum density.

Example 3

Emulsions 11 to 20 were prepared in the same manner as Emulsions 1 to 5 of Example 1 except that the tellurium sensitizer was replaced by a substantially equimolar amount of a sulfur sensitizer in the form of sodium thiosulfate or a selenium sensitizer in the form of triphenylphosphine selenide. Using these Emulsions 11 to 20, coated sample Nos. 13 to 22 were prepared as in Example 1. The coated samples were examined by sensitometry as in Example 1. The sensitometry results of these samples are shown in Table 4. It is noted that the sensitivity is a relative sensitivity based on a sensitivity of 120 for sample No. 1.

TABLE 4

| Sample No. | Emulsion | Chalcogen sensitizer | S | Fog |
|---|---|---|---|---|
| 1 | 1 | Tellurium | 120 | 0.16 |
| 2 | 2 | Tellurium | 250 | 0.16 |
| 3 | 3 | Tellurium | 430 | 0.17 |
| 4 | 4 | Tellurium | 530 | 0.20 |
| 5 | 5 | Tellurium | 600 | 0.23 |
| 13 | 11 | Sulfur | 50 | 0.16 |
| 14 | 12 | Sulfur | 150 | 0.16 |
| 15 | 13 | Sulfur | 220 | 0.17 |
| 16 | 14 | Sulfur | 450 | 0.20 |
| 17 | 15 | Sulfur | 550 | 0.23 |
| 18 | 16 | Selenium | 90 | 0.16 |
| 19 | 17 | Selenium | 200 | 0.1 |
| 20 | 18 | Selenium | 350 | 0.17 |
| 21 | 19 | Selenium | 470 | 0.20 |
| 22 | 20 | Selenium | 575 | 0.23 |

Example 4

Emulsions 21 to 30 were prepared as were Emulsions 2 and 5 of Example 1 except that the amount of the iridium compound added was changed or potassium ferrocyanide was added instead of the iridium compound as shown in Table 5. Using these Emulsions 21 to 30, coated sample Nos. 23 to 32 were prepared as in Example 1. The coated samples were examined by sensitometry as in Example 1. The results are shown in Table 5.

TABLE 5

| Sample No. | Emulsion | Amount of Ir compound added | Amount of $K_4[Fe(CN)_6]$ added | S | Fog |
|---|---|---|---|---|---|
| 2 | 2 | $1 \times 10^{-4}$ | — | 250 | 0.16 |
| 23 | 21 (2) | — | — | 150 | 0.16 |
| 24 | 22 (2) | $3 \times 10^{-5}$ | — | 230 | 0.16 |
| 25 | 23 (2) | $1 \times 10^{-5}$ | — | 200 | 0.16 |
| 26 | 24 (2) | $3 \times 10^{-6}$ | — | 160 | 0.16 |
| 27 | 25 (2) | — | $1 \times 10^{-4}$ | 230 | 0.16 |
| 28 | 26 (2) | $1 \times 10^{-5}$ | $1 \times 10^{-4}$ | 250 | 0.16 |
| 5 | 5 | $1 \times 10^{-4}$ | — | 600 | 0.23 |
| 29 | 27 (5) | — | — | 650 | 0.23 |
| 30 | 28 (5) | $3 \times 10^{-6}$ | — | 700 | 0.23 |
| 31 | 29 (5) | $1 \times 10^{-5}$ | — | 650 | 0.23 |
| 32 | 30 (5) | $3 \times 10^{-5}$ | — | 610 | 0.23 |

Note that the amount of iridium compound or potassium ferrocyanide is expressed in mol per mol of Ag. In the "Emulsion" column, the numeral in parentheses indicates the original emulsion.

Example 5

Emulsions 31 to 33 were prepared in the same manner as were Emulsions 1 to 3 of Example 1 except that aqueous hydrogen peroxide as the oxidizing agent was omitted. Coated sample Nos. 33 to 35 were similarly prepared therefrom.

Accelerated Aging Test

Each coated sample was cut to sections of 30.5 cm×25.4 cm with rounded corners having a curvature radius of 0.5 cm. The sections were allowed to stand for one day under conditions of 25° C. and RH 50%. Ten sections of each coated sample were placed in a bag of moisture-proof material, which was sealed and placed in a decorative box of 35.1 cm×26.9 cm×3.0 cm. In this state, the coated sample was aged at 50° C. for 5 days (accelerated aging). The sample was processed as in the photographic test of Example 1, whereupon the density of fog areas was measured. For the original sample Nos. 1 to 3 and sample Nos. 33 to 35 prepared in this Example, the fog after aging is shown in Table 6.

TABLE 6

| Sample No. | Emulsion | Addition of $H_2O_2$ | Fog after accelerated aging |
|---|---|---|---|
| 1 | 1 | added | 0.18 |
| 2 | 2 | added | 0.18 |
| 3 | 3 | added | 0.20 |
| 33 | 31 (1) | no | 0.22 |
| 34 | 32 (2) | no | 0.23 |
| 35 | 33 (3) | no | 0.25 |

Note that in the "Emulsion" column, the numeral in parentheses indicates the original emulsion.

It is seen from Table 6 that the emulsions within the scope of the invention are suppressed from fogging upon aging by virtue of the oxidizing agent added during grain formation.

Example 6

Emulsions 34 to 41 were prepared as were Emulsions 2 and 5 of Example 1 except that potassium iodide was added to solution (b2). There were obtained silver iodobromide emulsions having iodide contents as shown in Table 7. Using these Emulsions 34 to 41, coated sample Nos. 36 to 43 were prepared as in Example 1. The coated samples were examined by sensitometry as in Example 1 and the image retention against illumination test as in Example 2. The results are shown in Table 7.

TABLE 7

| Sample No. | Emulsion | Iodide content (mol %) | Fog | S | Illuminated image retention |
|---|---|---|---|---|---|
| 2 | 2 | 0 | 0.16 | 250 | Excellent |
| 36 | 34 (2) | 2 | 0.14 | 240 | Excellent |
| 37 | 35 (2) | 4 | 0.11 | 220 | Excellent |
| 38 | 36 (2) | 6 | 0.11 | 150 | Excellent |
| 39 | 37 (2) | 10 | 0.14 | 80 | Excellent |
| 5 | 5 | 0 | 0.23 | 600 | Good |
| 40 | 38 (5) | 2 | 0.22 | 400 | Good |
| 41 | 39 (5) | 4 | 0.21 | 200 | Good |
| 42 | 40 (5) | 6 | 0.20 | 120 | Excellent |
| 43 | 41 (5) | 10 | 0.20 | 60 | Excellent |

Note that in the "Emulsion" column, the numeral in parentheses indicates the original emulsion.

It is seen from Table 7 that silver halide grains with a mean equivalent spherical diameter of up to 50 nm provide sensitivity maintenance, reduced fog, and excellent image retention when the iodide content is below 5 mol %.

Japanese Patent Application No. 95080/1998 is incorporated herein by reference.

Reasonable modifications and variations are possible from the foregoing disclosure without departing from either the spirit or scope of the present invention as defined by the claims.

What is claimed is:

1. A photothermographic element comprising at least one photosensitive layer on a support, wherein said element contains a non-photosensitive silver salt of a long-chain aliphatic carboxylic acid having 10–30 carbon atoms, a reducing agent for silver ion, and an emulsion of photosensitive silver halide fine grains having a mean equivalent spherical diameter of 10 to 50 nm, said silver halide emulsion has been performed independent of the silver salt and subsequently mixed with the silver salt before coating, and the silver halide fine grains have been chemically sensitized in the presence of a spectral sensitizing dye, wherein the photothermographic element is prepared by the following sequential steps:

(A) forming said photosensitive silver halide emulsion independent of the non-photosensitive aliphatic carboxylic acid silver salt, the emulsion containing silver halide fine grains having a mean equivalent spherical diameter of 10 to 50 nm, (B) adding a spectral sensitizing dye to the photosensitive silver halide emulsion, (C) chemically sensitizing the silver halide fine grains in the presence of said spectral sensitizing dye, (D) mixing the silver halide emulsion with the non-photosensitive aliphatic carboxylic acid silver salt, and (E) coating the resulting mixture onto the support.

2. The photothermographic element of claim 1 wherein said emulsion has been subjected to selenium sensitization or tellurium sensitization or both.

3. The photothermographic element of claim 1 wherein said emulsion contains $10^{-5}$ to $10^{-3}$ mol of a polyvalent metal ion per mol of the silver halide.

4. The photothermographic element of claim 1 wherein the silver halide fine grains of said emulsion have faces in which {100} face accounts for 50 to 100% of the entire faces.

5. The photothermographic element of claim 1 wherein the silver halide fine grains of said emulsion have been formed in the presence of an oxidizing agent for silver.

6. The photothermographic element of claim 1 wherein the silver halide fine grains have a mean equivalent spherical diameter of 10 to 30 nm.

7. The photothermographic element of claim 1 wherein said spectral sensitizing dye is a merocyanine dye having an absorption peak at a wavelength in the range of 600 to 1,000 nm.

8. The photothermographic element of claim 1 wherein the silver halide fine grains have a silver iodide content of 0 to 5 mol %.

9. The photothermographic element of claim 1 wherein said emulsion contains a triazine compound.

10. The photothermographic element of claim 3 wherein the polyvalent metal ion is an iridium, ruthenium or iron ion and coordinates with a Cl, Br or CN ion.

11. The photothermographic element of claim 1 further comprising a water-soluble polymer or water-dispersible polymer or both as a binder.

12. The photothermographic element of claim 1, wherein said non-photosensitive long-chain aliphatic carboxylic acid silver salt has 15 to 28 atoms.

13. A method for preparing a photothermographic element comprising a support and at least one photosensitive layer thereon containing a non-photosensitive silver salt of a long-chain aliphatic carboxylic acid having 10–30 carbon atoms, a reducing agent for silver ion, and a photosensitive silver halide, said method comprising the following sequential steps:

(A) forming a photosensitive silver halide emulsion independent of the non-photosensitive photosensitive aliphatic carboxylic acid silver salt, the emulsion containing silver halide fine grains having a mean equivalent spherical diameter of 10 to 50 nm, (B) adding a spectral sensitizing dye to the photosensitive silver halide emulsion, (C) chemically sensitizing the silver halide fine grains in the presence of said spectral sensitizing dye, (D) mixing the silver halide emulsion with the non-photosensitive aliphatic carboxylic acid silver salt, and (E) coating the resulting mixture onto the support.

14. The method of preparing a photothermographic element of claim 13, wherein the amount of the sensitizing dye is in the amount of about $10^{-6}$ to 1 mol per mol of the silver halide in the photosensitive layer.

15. The method of preparing a photothermographic element of claim 13 wherein the amount of the sensitizing dye is in the amount of about $10^{-4}$ to $10^{-1}$ mol per mol of the silver halide in the photosensitive layer.

16. The method according to claim 13, wherein said non-photosensitive long-chain aliphatic carboxylic acid silver salt has 15 to 28 carbon atoms.

* * * * *